US008443618B2

(12) United States Patent
Friedmann et al.

(10) Patent No.: US 8,443,618 B2
(45) Date of Patent: May 21, 2013

(54) REFRIGERATING AND/OR FREEZING APPLIANCE

(75) Inventors: Volker Friedmann, Biberach (DE); Christian Schropp, Sontheim (DE)

(73) Assignee: Liebherr-Hausgeraete Ochsenhausen GmbH, Ochsenhausen (DE)

( * ) Notice: Subject to any disclaimer, the term of this patent is extended or adjusted under 35 U.S.C. 154(b) by 534 days.

(21) Appl. No.: 11/884,609

(22) PCT Filed: Feb. 2, 2006

(86) PCT No.: PCT/EP2006/000918

§ 371 (c)(1),
(2), (4) Date: Sep. 21, 2007

(87) PCT Pub. No.: WO2006/087107

PCT Pub. Date: Aug. 24, 2006

(65) Prior Publication Data

US 2008/0163635 A1 Jul. 10, 2008

(30) Foreign Application Priority Data

Feb. 16, 2005 (DE) ..... 20 2005 002 486 U

(51) Int. Cl.
*F25D 21/06* (2006.01)

(52) U.S. Cl.
USPC ..... 62/276; 62/275; 62/515

(58) Field of Classification Search
USPC ..... 62/275, 276, 515
See application file for complete search history.

(56) References Cited

U.S. PATENT DOCUMENTS

| | | | | | |
|---|---|---|---|---|---|
| 2,551,163 | A | * | 5/1951 | Rickert et al. | 62/155 |
| 3,182,467 | A | * | 5/1965 | Beckwith | 62/256 |
| 5,675,984 | A | * | 10/1997 | Shin | 62/276 |
| 6,140,623 | A | * | 10/2000 | Boehnlein et al. | 219/541 |

FOREIGN PATENT DOCUMENTS

| | | |
|---|---|---|
| CN | 1136162 | 11/1996 |
| DE | 19645182 | 5/1998 |
| JP | 10185399 | 7/1998 |
| JP | 11237163 | 8/1999 |
| JP | 11281232 | 10/1999 |
| JP | 2003148857 | 5/2003 |
| JP | 2004245452 | 9/2004 |
| WO | 2006013762 | 2/2006 |

OTHER PUBLICATIONS

Machine translation of JP 11281232, Oct. 15, 1999, Miyata Atsuya.*
Machine translation of DE 19645182, May 7, 1998, Horn Klaus Dipl Ing et al.*

* cited by examiner

*Primary Examiner* — Cheryl J Tyler
*Assistant Examiner* — Jonathan Koagel
(74) *Attorney, Agent, or Firm* — Alleman Hall McCoy Russell & Tuttle LLP

(57) ABSTRACT

A cooling and/or freezing device, in particular a refrigerator, upright freezer or chest freezer, includes an evaporator for cooling air, a blower for supplying the cooled air into the interior of the cooling and/or freezing device, and a first heater for de-icing the evaporator. The device also includes, a second heater, arranged such that during operation of the second heater, the temperature of the blower surface lies above the dew point of the air present in the vicinity of the blower, at least in certain regions.

16 Claims, 3 Drawing Sheets

REFRIGERATING AND/OR FREEZING APPLIANCE

CROSS-REFERENCE TO RELATED APPLICATIONS

Figure 1:
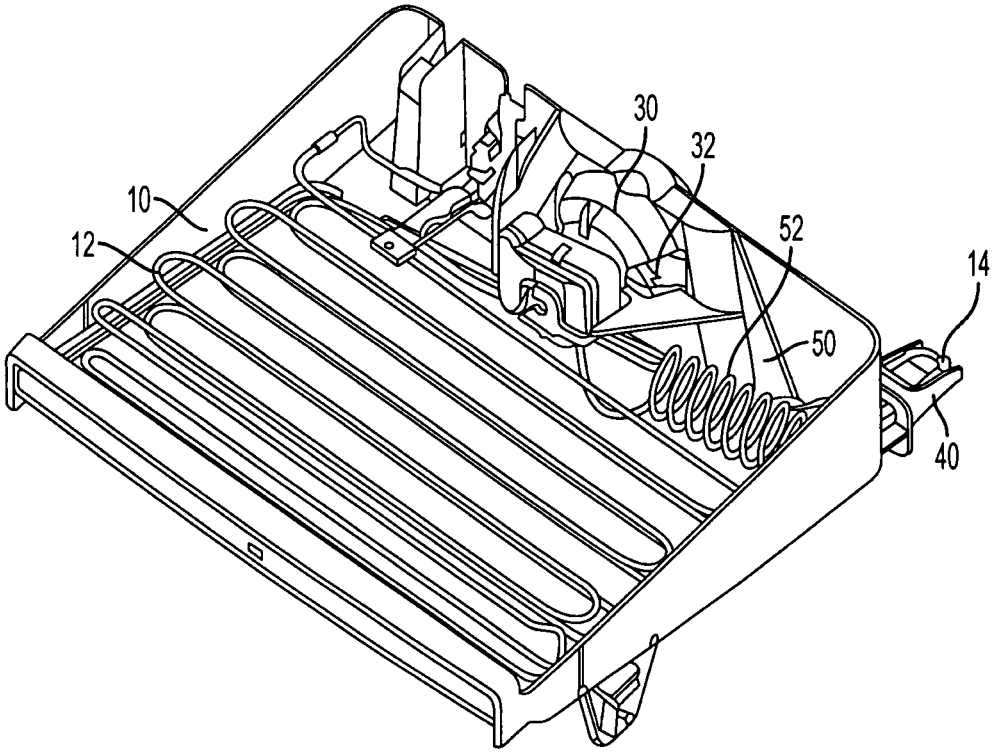

This application claims priority to German Utility Model Application No. 20 2005 002 486.4, filed on Feb. 16, 2005, and to PCT Application Nos. PCT/EP2006/000918, filed on Feb. 2, 2006, both of which are hereby incorporated by reference in their entirety for all purposes.

This invention relates to a cooling and/or freezing device, in particular a refrigerator, upright freezer or chest freezer, comprising an evaporator for cooling air, a blower for supplying the cooled air into the interior of the cooling and/or freezing device, and a first heating means for removing ice formed on the evaporator.

Such cooling and/or freezing device is known for instance from DE 196 45 182 A1. Both in the case of cooling and/or freezing devices with an evaporator disposed in the cooling space and in the case of cooling and/or freezing devices whose evaporator is disposed outside the cooling space, for instance in a cooling passage separated from the cooling space by a partition, the problem exists that ice forms on the evaporator in the course of time, which negatively impairs its operability or cooling capacity. Therefore, defrosting heaters are known, which preferably are operated when the compressor of the cooling circuit is out of operation. Such defrosting heater for instance can be a tubular heater or a radiant heater.

While the evaporator is defrosted, humid air is generated by nature, whose humidity is deposited for instance on the blower of the cooling and/or freezing device. When the evaporator is put into operation after the defrosting phase, the problem arises that as a result of the cool air produced by means of the evaporator, the humidity deposited can lead to icing and hence to malfunctions of the blower.

It is the object of the invention to develop a cooling and/or freezing device as mentioned above such that the risk of icing of the blower upon starting the evaporator after the defrosting operation is reduced.

This object is solved by a cooling and/or freezing device with the features of claim 1. Accordingly, it is provided that a second heating means is provided, which is arranged such that in operation of the second heating means, the temperature of the blower surface lies above the dew point of the air present in the vicinity of the blower at least in certain regions. The function of the second heating means thus consists in heating the blower during the defrosting operation directly or indirectly such that there is no deposition of humidity in the vicinity of the blower. This provides the advantage that during operation of the evaporator, the formation of ice on or in the blower, in particular on the ventilator blade, can effectively be prevented.

Further advantageous aspects of the invention are subject-matter of the sub-claims.

A particularly fast and effective heating of the air and hence of the blower is achieved when at least portions of the second heating means have a spiral or helical design. The design of the second heating means largely can be as desired, as long as it is ensured that the temperature of the blower surface is maintained above the dew point, in order to avoid a condensation. The second heating means can be designed for instance as tubular heater or as thermal radiator.

The second heating means can be an integral part of the first heating means. It is conceivable, for instance, that the second heating means constitutes a portion of the first heating means. The above-mentioned spiral or helical region which forms the second heating means can form part of the first heating means and be formed integral with the same.

It is of course also conceivable that the first and second heating means are separate components, i.e. are arranged separately and/or are operated separate from each other.

The blower of the cooling and/or freezing device can be an axial blower. This provides a cost advantage as compared to the use of a radial blower.

In accordance with a further aspect of the invention it is provided that the blower comprises a ventilator and a diffuser. Due to the fact that the temperature does not fall below the dew point of the air in the vicinity of the blower, a blower with diffuser can be used. Exit losses thereby are reduced, and the exposure of succeeding elements is improved. This contributes to the fact that a better class of energy efficiency is achieved.

A further advantage of the invention consists in that a foil heater on the housing wall in the vicinity of the blower can be omitted.

Furthermore, a water drain channel can be provided, the first and/or second heating means being designed such that the water drain channel is heatable by the first and/or second heating means. It is conceivable, for instance, that a loop of the heater, which is located in the vicinity of the water outlet, provides for omitting a separate heater of the water drain channel. Accordingly, a further advantage of the invention consists in that a foil heater is not provided in the vicinity of the water drain channel.

The first heating means of the cooling and/or freezing device can for instance be designed as tubular heater. It can be disposed on one side or on both sides of the evaporator. As stated above, a further portion of the tubular heater can form the second heating means.

An efficient defrosting of the evaporator is obtained when the first heating means has a spiral or meander-shaped design. The second heating means can integrally be attached to this spiral or meander-shaped portion.

Figure 2:
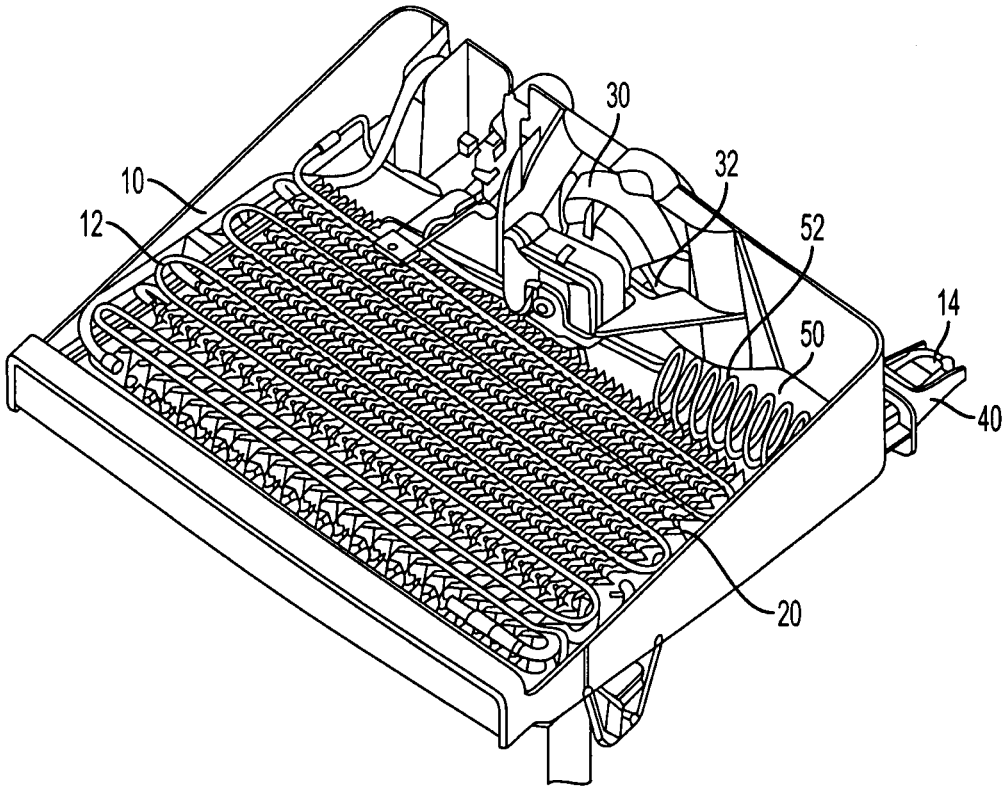
Figure 3:
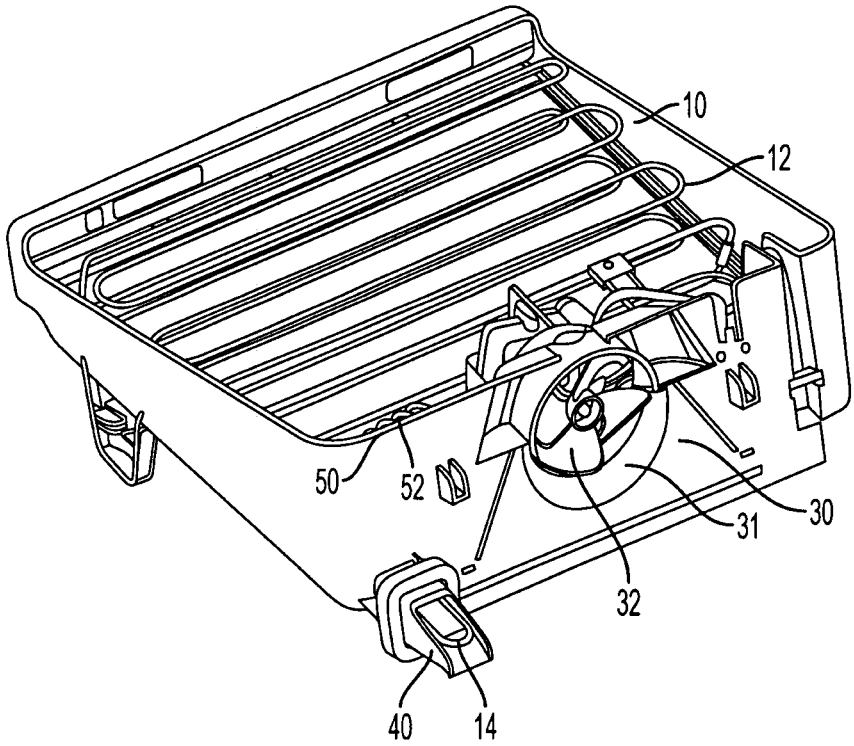

Further details and advantages of the invention can be taken from an embodiment shown in the drawing, in which:

FIG. 1: shows a perspective view of the defrosting heater of the cooling and/or freezing device in accordance with the invention without evaporator, FIG. 2: shows a view in accordance with FIG. 1 with evaporator, and FIG. 3: shows a further perspective view of the arrangement as shown in FIG. 1.

FIG. 1 shows a perspective view of the defrosting heater designed in the form of a tubular heater, which comprises the first heating means 10 and the second heating means 50. FIG. 3 shows the arrangement of FIG. 1 in a view of the end face including the blower 30. The first heating means 10 consists of the meander-shaped tubular heater 12, which extends parallel to the front and rear sides of the evaporator 20, as can be taken from FIG. 2. The second heating means 50 consists of the helical portion 52 of the tubular heater. Both heating means 10, 50 are parts of the same tubular heater and thus are in fluid communication with respect to the traversal of the heating medium.

Reference numeral 30 designates the axial blower, which serves to convey the air cooled by means of the evaporator 20 into the interior of the cooling and/or freezing device. Reference numeral 32 designates a ventilator blade of the blower 30. Reference numeral 31 in FIG. 3 designates the diffuser of the axial blower 30.

The axial blower 30 approximately centrally adjoins the plane formed by the first heating means 10. The second heating means 50 is disposed laterally offset with respect to the blower 30 and approximately at the level thereof or at the level of the electric motor driving the blower 30.

Furthermore, a groove-like water outlet 40 is provided, in which a loop 14 of the tubular heater is disposed, which heats the water outlet 40 during operation of the tubular heater.

As can be taken from FIG. 1 and FIG. 2, a portion of the tubular heater is designed in the form of a helix 52. This portion forms the second heating means 50 of the invention. The same is integrally formed with the first heating means 10, i.e. the first and second heating means 10, 50 are parts of one and the same heater.

The helix 52 and the second heating means 50 are located in the vicinity of the defrosting heater, which faces the blower 30, as can be taken from FIGS. 1 and 2.

In operation of the defrosting heater, the heating medium traversing the tubular heater first enters through a heating medium inlet into the helix 52 of the second heating means 50 and traverses the same. Due to the comparatively great length of the heating line per unit area or volume of the second heating means 50, the air is heated rapidly. Due to the arrangement of the blower 30 and the second heating means 50 next to each other, the air heated in this way also leads to a rapid heating of the diffuser 31 and of the ventilator blade 32, which leads to the fact that from the humid air flowing over these components no or substantially no humidity is condensated out.

Upon traversal of the second heating means 50, the loop 14 of the tubular heater is traversed, which is located in the water outlet 40 and heats the same.

The heating medium then is introduced into the tubular heater 12 arranged in a meander-shaped manner, which forms the first heating means 10 and is arranged in two planes, between which the evaporator 20 of the cooling and/or freezing device is located.

Upon traversal of the first heating means 10, the heating medium is discharged via a heating medium outlet.

The cooling and/or freezing device of the invention has the advantage that one heater is sufficient for performing the defrosting operation of the evaporator such that icing is avoided in the vicinity of the blower. However, the use of several heating means is not excluded either. The invention allows to omit the foil heaters known from the prior art.

Since the avoidance of icing is achieved in accordance with the invention, an axial blower can be used, which is more favorable as compared to radial blowers. In conjunction with the diffuser 31 shown in FIG. 3, the blower achieves a good increase in pressure and generally better ventilation values. From the prior art, the use of a ventilator with orifice plate is known. On the orifice plate, no water droplet can be left, but such an arrangement has certain disadvantages in terms of ventilation.

The invention is not restricted to a special type of heating means. For instance, the use of a radiator, e.g. a light bulb, is also conceivable. Such a solution, however, is comparatively expensive, as further components (socket, lamp, cable etc.) are necessary.

The invention claimed is:

1. A cooling and/or freezing device comprising:

an evaporator arranged to cool air in an interior of the device;

a blower coupled to an enclosure that surrounds the evaporator, the blower configured to blow cooled air from within the enclosure into the interior of the device;

a tubular heater comprising a flowing heating medium, a first portion of the heater arranged on one or both sides of the evaporator, and a second portion of the heater arranged adjacent the blower, in a space through which air passes en route to the blower to heat the blower during defrosting, the second portion arranged to receive the flowing heating medium adjacent the blower before the first portion receives the flowing heating medium on the one or both sides of the evaporator, wherein during operation of the heater, a temperature of a blower surface lies above a dew point of air present in a vicinity of the blower.

2. The cooling and/or freezing device according to claim 1, wherein the second portion of the heater is at least partly spiral and/or helical.

3. The cooling and/or freezing device according to claim 1, wherein the second portion of the heater comprises a helical tubular portion arranged upstream of the blower in a blower air-flow direction.

4. The cooling and/or freezing device according to claim 1 wherein the blower is an axial blower.

5. The cooling and/or freezing device according to claim 1, wherein the blower comprises a ventilator and a diffuser.

6. The cooling and/or freezing device according to claim 1, wherein a foil heater is not provided on a housing wall in the vicinity of the blower.

7. The cooling and/or freezing device according to claim 1, further comprising a water drain channel, wherein the heater further comprises a loop portion arranged in the water drain channel downstream of the second portion and upstream of the first portion in a flow direction of the heating medium, such that the heating medium circulates through the second portion, then through the loop portion, and then through the first portion.

8. The cooling and/or freezing device according to claim 7, wherein a foil heater is not provided in a vicinity of the water drain channel.

9. The cooling and/or freezing device according to claim 1, wherein at least the first portion of the heater is tubular.

10. The cooling and/or freezing device according to claim 1, wherein the first portion of the heater comprises a meander-shaped tubular portion arranged on one side of the evaporator.

11. The cooling and/or freezing device according to claim 1, the device being a refrigerator, upright freezer, or chest freezer.

12. The cooling and/or freezing device according to claim 1, wherein the blower is arranged downstream of the evaporator in a direction of air flow in the device.

13. A cooling and/or freezing device comprising:

an evaporator arranged to cool air in an interior of the device;

a blower coupled to an enclosure that surrounds the evaporator, the blower configured to blow cooled air from within the enclosure into the interior of the device;

a tubular heater comprising a flowing heating medium, a first portion of the heater arranged on one or both sides of the evaporator, a second portion of the heater arranged adjacent the blower in a space through which air passes en route to the blower to heat the blower during defrosting, and a third portion of the heater arranged in a water outlet extending through the enclosure, the heating medium flowing directly from the second portion to the third portion and directly from the third portion to the first portion, wherein during operation of the heater, a temperature of a blower surface lies above a dew point of air present in a vicinity of the blower.

14. The cooling and/or freezing device according to claim 13, wherein said device is a refrigerator, upright freezer or chest freezer, and wherein at least some of the second portion of the heater has a spiral and/or helical structure.

15. The cooling and/or freezing device according to claim 14, wherein the blower is an axial blower.

16. The cooling and/or freezing device according to claim 13, wherein the blower is arranged downstream of the evaporator in a direction of air flow in the device.

* * * * *

UNITED STATES PATENT AND TRADEMARK OFFICE

CERTIFICATE OF CORRECTION

PATENT NO. : 8,443,618 B2
APPLICATION NO. : 11/884609
DATED : May 21, 2013
INVENTOR(S) : Friedmann et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 622 days.

Signed and Sealed this
Eighth Day of September, 2015

Michelle K. Lee

Michelle K. Lee
*Director of the United States Patent and Trademark Office*